US005188086A

United States Patent [19]

Adkins et al.

[11] Patent Number: 5,188,086

[45] Date of Patent: Feb. 23, 1993

[54] EXHAUST GAS RECIRCULATION COUPLER AND DIFFERENTIAL VENTURI

[75] Inventors: Delbert L. Adkins; Raymond R. Brauckmiller, both of Mount Clemens; Dennis C. Soles, Rochester Hills, all of Mich.

[73] Assignee: Bundy Corporation, Warren, Mich.

[21] Appl. No.: 863,804

[22] Filed: Apr. 6, 1992

[51] Int. Cl.[5] ..... F02M 25/07

[52] U.S. Cl. ..... 123/568

[58] Field of Search ..... 123/568, 569, 570, 571; 285/302

[56] References Cited

U.S. PATENT DOCUMENTS

| | | | |
|---|---|---|---|
| 1,645,347 | 10/1927 | Pierson | 123/568 |
| 1,793,556 | 2/1931 | Moore | 123/568 |
| 2,258,902 | 10/1941 | Marx et al. | 123/568 |
| 4,030,740 | 6/1977 | Kniss, Jr. et al. | 285/302 X |
| 4,201,048 | 5/1980 | Fisher et al. | 285/302 X |
| 4,485,794 | 12/1984 | Kimberley et al. | 123/568 X |
| 4,683,863 | 8/1987 | Sugiura | 123/568 |
| 4,693,226 | 9/1987 | Choma | 123/568 |
| 4,705,009 | 11/1987 | Asayama | 123/571 |
| 4,715,348 | 12/1987 | Kobayashi et al. | 123/571 |
| 4,875,455 | 10/1989 | Hashimoto et al. | 123/568 |
| 4,932,686 | 6/1990 | Anderson, Jr. | 285/302 X |

*Primary Examiner*—Willis R. Wolfe

*Attorney, Agent, or Firm*—Barnes, Kisselle, Raisch, Choate, Whittemore & Hulbert

[57] ABSTRACT

An adjustable recirculation exhaust gas pressure differential venturi and coupler adapted to be coupled between an exhaust and an intake of an automotive-type engine and which receives exhaust gases from the exhaust for recirculation back through the intake. A valve having a chamfered orifice is located within the tubular coupler for controlling the flow of exhaust gases through the coupler thus controlling the pressure differential therein. The coupler is a two piece assembly with a telescopic connection which allows for axial and rotational adjustments.

12 Claims, 2 Drawing Sheets

EXHAUST GAS RECIRCULATION COUPLER AND DIFFERENTIAL VENTURI

FIELD OF THE INVENTION

This invention relates generally to an exhaust gas recirculation (EGR) system for an automotive-type engine for returning part of the exhaust gas of the engine to the intake manifold. More particularly, the invention relates to an adjustable differential venturi and coupler adapted to be mounted between an intake and an exhaust manifold of the engine.

BACKGROUND OF THE INVENTION

An EGR system, as is known, recirculates part of the exhaust gas back to the intake of an engine for reducing harmful nitrous oxide emissions. Fuel consumption and engine performance are affected by the recirculated exhaust gas flow. For example, engine performance may be affected by the temperature of the exhaust gas which is higher than that of the fresh air-fuel mixture introduced into the combustion chamber. The "hot" exhaust gas acts to heat up the combustible mixture thus facilitating the combustibility of the air-fuel mixture. As is known, the amount of exhaust gas returned is controlled by an EGR valve that is opened and closed by a control unit depending on operating conditions of the engine. To minimize exhaust gas emissions, it is important to accurately control the amount of exhaust gas recirculated according to engine operating conditions, such as, engine speed, temperature, altitude, exhaust gas pressure and temperature. Typically, with a cold start of the engine the EGR valve is initially closed to prevent recirculation, opened immediately after starting to recirculate exhaust gas to more quickly heat the engine and promote more complete combustion of fuel, and then closed when the engine warms up to operating temperature.

Prior couplers were a one-piece steel tube with an integral and slightly flexible bellows section. An orifice was disposed in the tube with only one pressure tap on one side of the orifice for a pressure sensor providing a signal used in controlling the EGR valve. The one-piece tube required close manufacturing and assembly tolerances for both the coupler and the engine to accurately locate the exhaust manifold and intake manifold mounting surface for the coupler. In service, the coupler became stressed, fatigued and cracked which resulted in expensive warranty, service and replacement costs for both manufacturers and consumers.

SUMMARY OF THE INVENTION

The EGR coupler is adapted to be mounted between the exhaust manifold and an EGR control valve connected to an engine intake manifold. The EGR coupler has a baffle with a chamfered orifice forming a venturi therein for creating an exhaust gas pressure differential within the coupler. At least one but preferably two pressure taps, one on each side of the baffle, are provided for the exhaust gas pressure differential.

The EGR coupler also has a telescoping assembly adjustable axially and rotatably to increase flexibility in installation and decrease stress cracking.

Objects, features and advantages of this invention are to provide an EGR coupler and venturi which provides an improved differential pressure control signal, is easily adjustable to accommodate a wide variation in manufacturing and assembly tolerances, eliminates stress and cracking in use, has a long and improved useful life in service, is of relatively simple design and economical manufacture and assembly, and can be used on both new engines and utilized to retrofit and replace EGR couplers on engines already in the field.

BRIEF DESCRIPTION OF THE DRAWINGS

These and other objects, features and advantages of this invention will be apparent from the following detailed description, appended claims and accompanying drawings in which:

DETAILED DESCRIPTION OF THE PREFERRED EMBODIMENT

Figure 1:
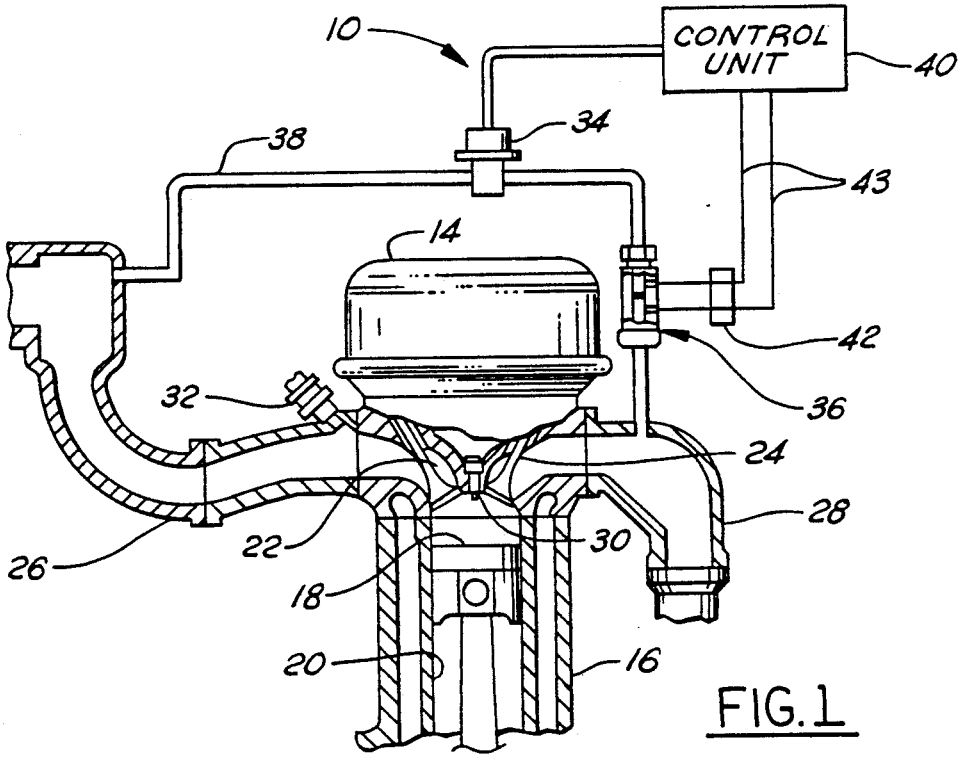
FIG. 1 is a schematic diagram of an EGR system for an engine utilizing a coupler of this invention.

FIG. 1 illustrates an exhaust gas recirculation system 10 for an internal combustion engine 12. The engine may be of conventional construction with a head 14 secured to a block 16 having pistons 18 slidably received in cylinders 20 and intake and exhaust valves 22 and 24 for each cylinder. Combustion air is supplied to the cylinder 20 from an intake manifold 26 and exhaust gases pass through an exhaust manifold 28. The engine fuel or gasoline is ignited by its plug 30. Typically, fuel is supplied to the engine through a fuel injector 32 or a carburetor mounted on the intake manifold. As the engine may be of conventional construction, it will not be described in further detail.

The EGR system comprises a control valve 34 with an exhaust gas inlet connected to the exhaust manifold by a coupler 36 embodying this invention. The outlet of the control valve is connected to the intake manifold either directly or through a tube 38. The control valve 34 is opened and closed in response to engine operating conditions by a control unit 40 which frequently is a part an electronic engine control module. Typically, while a cold engine is being started, the control unit closes the valve so that no exhaust gas is recirculated to the intake manifold. Once the engine starts, the control valve 34 opens to recirculate a portion of the hot exhaust gases through the intake manifold to more rapidly vaporize the fuel and heat the engine to its normal operating temperature. When the engine reaches a predetermined elevated temperature, the valve again closes to stop further recirculation of exhaust gas. To provide an indication of the volume or quantity of gas being recirculated with the valve 34 open, in accordance with this invention, a transducer 42 is connected to taps on opposite sides of a venturi in the coupler to sense a differential pressure across the venturi and produce a preferably electric signal in response to variations in and indicative of the magnitude of this differential pressure. The output of the transducer is connected to the control unit through electric wires 43.

Figure 2:
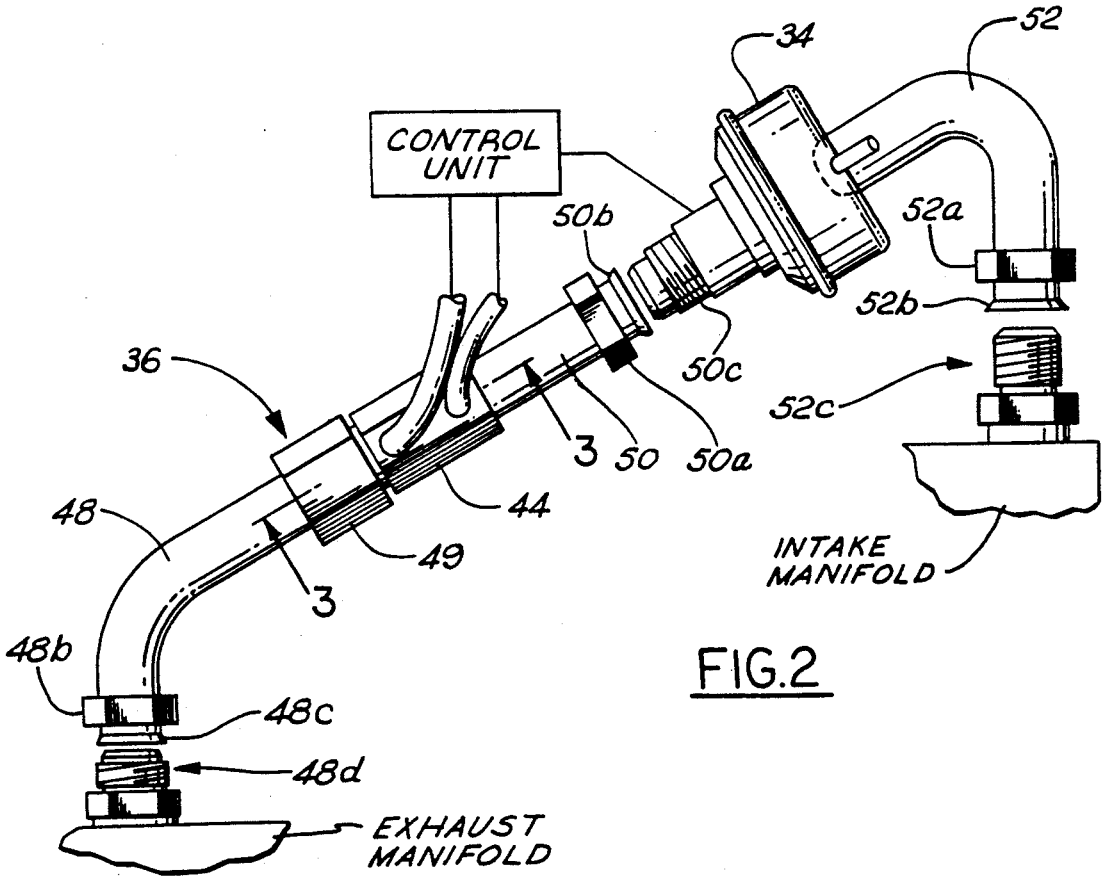
FIG. 2 is an exploded side view of the EGR coupler embodying this invention disposed between the exhaust manifold and a control valve connected to an intake manifold of an engine.

As shown in FIG. 2, the coupler has a body 44 connected by an inlet tube 48 to the exhaust manifold at one end. The other end of body 44 is connected by an outlet tube 50 to the inlet of the control valve 34. The outlet of the control valve is connected to a rigid tube 52 connected to the intake manifold.

Figure 3:
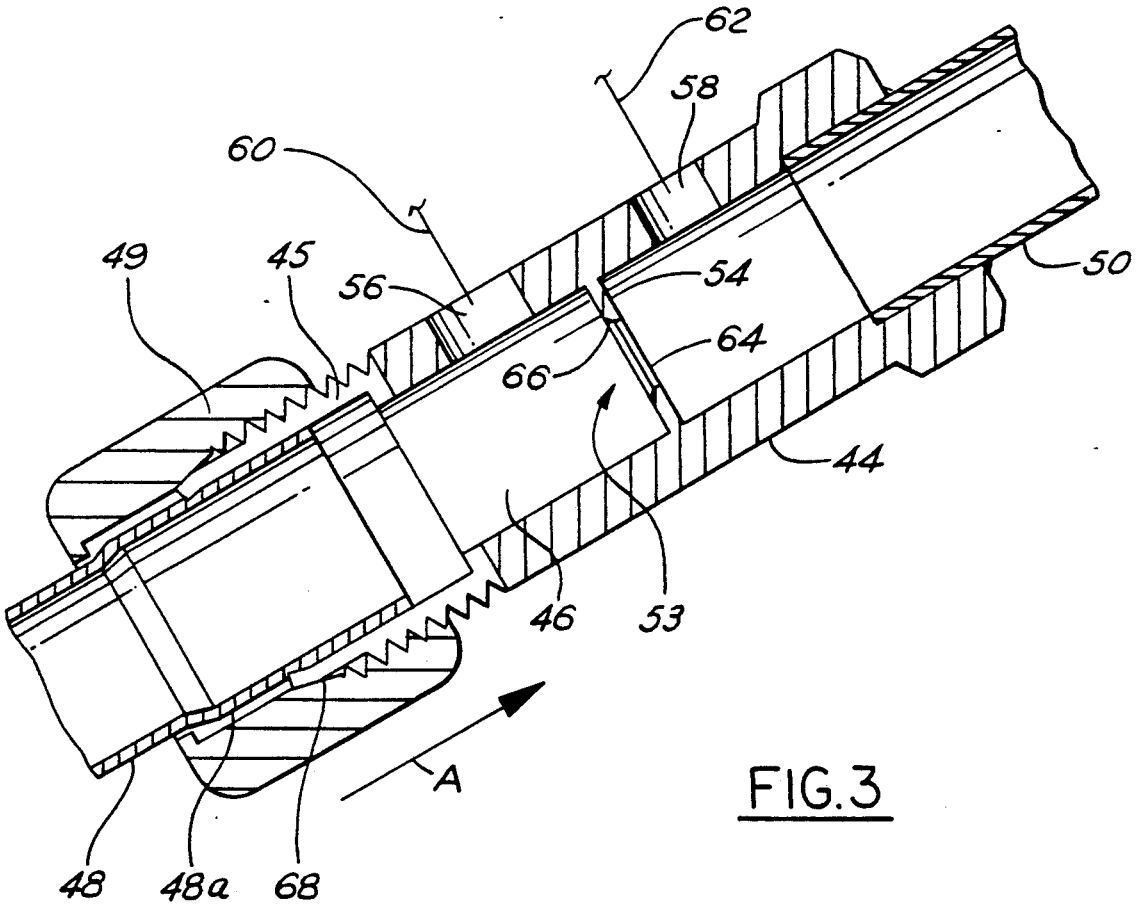
FIG. 3 is a cross sectional view through lines 3-3 of FIG. 2.

As shown in FIG. 3, body 44 has a through passage 46 and a venturi 53 is formed in the body by a restricter plate or baffle 54 in the passage. Ports 56 and 58, one on each side of the restricter plate, communicate with separate pressure taps or tubes 60 and 62, each connected by hoses (not shown) to the transducer 42. The restricter plate 54 has a central orifice 64, as shown, with a rounded entry and preferably a chamfered entry 66 on the upstream side of the flow of exhaust gas through the passage in the direction of arrow A.

In mass producing orifices, the rounded or preferably chamfered entry 66 of the orifice is important to achieve consistent or substantially the same pressure drop for the same flow rate through the venturi from one venturi to another having the same configuration and the same nominal dimensions. Mass produced orifices having no rounded entry or chamfer 66 frequently have large variations in the pressure drop for the same flow rate, thus producing varying, erratic and unreliable signals for the control unit.

In one practical embodiment of the coupler for a V-6 engine, the passage 46 has an inside diameter of 0.560 of an inch, the restricter plate 54 has a thickness of about 0.140 of an inch, the orifice has a diameter of about 0.275 of an inch and the chamfer has an axial thickness of about 0.040 to 0.060 of an inch with its face inclined at an acute included angle to the axis of the orifice of 45°. When gas flows through the passage 46, the venturi 53 in the restricter plate 54 creates a pressure differential across the tubes 60 and 62 which varies with, and is a function of the flow rate of the gas through the passage and the differential pressure increases with increasing flow rate of the gas.

In accordance with another feature of the invention, the overall length of the coupler and the angular rotational orientation of its inlet and outlet tubes can be adjusted within predetermined limits of the coupler when connected between the exhaust manifold and the control valve.

As shown in FIGS. 2 and 3, the intake tube has an enlarged diameter 48*a* adjacent one end telescopically receivable in a counterbore in a threaded sleeve 45 on one end of the body 44 which communicates with the passage 46. The intake tube is coupled and sealed to the body by a collar 49 encircling the enlarged tubular portion 48*a* and in assembly is threaded onto the sleeve 45. The collar 49 has a cam surface 68 which is inclined and circumferentially continuous which engages the outer periphery of the free end of the sleeve 45 and swages or permanently deforms it generally radially inwardly into sealing engagement with the enlarged portion of the tube 48 as the collar 49 is threaded onto the sleeve.

Preferably, to facilitate assembly by permitting the axis of the tube 48 to be somewhat skewed or inclined to the axis of the passage of the body 44 without unduly stressing or flexing either the tube or the body, the inside diameter of the counterbored sleeve 45 is somewhat larger than the outside diameter of the large end portion 48*a* of the inlet tube and the inside diameter of the bore of the collar 49 is somewhat larger than the outside diameter of the main portion of the inlet tube. To retain the collar on the tube 48, preferably the inside diameter bore through the collar is also somewhat smaller than the outside diameter of the end portion of the tube 48. Limited changes in the rotational orientation of the inlet tube to the body and hence the outlet tube are also permitted by this coupling construction arrangement.

Preferably, the other end of the inlet tube has a coupling collar 48*b* slidably received thereon which terminates in a flange 48*c* for connecting the tube to a connector fitting 48*d* connected to the exhaust manifold. The collar 48*b*, tube flange 48*c* and connector fitting 48*d* provide a sealed or gas tight connection and may be of conventional construction.

One end of the outlet tube 50 is received in a counterbore in the other end of passage 46 and is sealed to the body, such as by brazing. To connect the outlet tube to the intake valve, a coupling collar 50*a* is received on the tube which has a flare 50*b* on its end for sealing engagement with a threaded fitting 50*c* connected to the inlet of the valve. The threaded collar 50*a*, tube flare 50*b* and coupling 50*c* may all be of conventional construction. The valve 34 has a curved outlet tube 52 with a conventional threaded coupling collar 52*a* and flare end 52*b* which cooperates with a complimentary fitting 52*c* on the intake manifold to sealingly connect the outlet tube 50 to the intake manifold.

Typically, the coupler is installed on an engine by first loosely assembling the inlet and outlet tubes 48, 50 to the exhaust and inlet manifolds, respectively. The collars 48*b*, 50*a* and 52*a* are then tightened sufficiently to seal and secure the inlet tube 48 to the exhaust manifold, the outlet tube 50 to the valve 34 and the valve outlet tube 52 to the intake manifold. This also aligns and positions the intake tube in the body of the coupler without stressing, bending or flexing any of the components by the assembly. Thereafter, the collar 49 is tightened sufficiently to swage and permanently deform the end portions of the nipple of the coupler into sealing engagement with the enlarged portion 48*a* of the inlet tube.

Thus, this coupling assembly accommodates substantial variation in the manufacturing and assembly tolerances and the location of all of the couplers, components, the valve, the outlet tube of the valve, the intake manifold, exhaust manifold, and mounting of the intake and exhaust manifolds on the engine block relative to each other. In the mass production and assembly of internal combustion engines, EGR systems and couplers there are substantial variations in tolerances, and the precise location and orientation of components to each other all of which are accommodated by the coupler assembly of this invention and its method of assembly to an engine.

I claim:

1. An exhaust recirculation pressure differential coupler and venturi comprising:

a coupler body having ends adapted to be connected between an exhaust manifold and an inlet manifold of an internal combustion engine for receiving exhaust gases flowing from the exhaust manifold;

an angular inlet tube having a first end connected to one end of said coupler body and adapted to be connected at a second end to the exhaust manifold;

an outlet tube having a first end connected to the other end of said coupler body and a second end adapted to be mounted to the inlet manifold; and adjusting means to adjust the axial length of the coupler and the angular orientation of said inlet tube with respect to said coupler body.

2. The exhaust recirculation pressure differential coupler and venturi as in claim 1 wherein said adjusting means comprises:

a threaded sleeve at said one end of said coupler body having a counterbore;

the first end of said inlet tube being enlarged and telescopically received in the counterbore; and securing means to lock said inlet tube to said coupler body.

3. The exhaust recirculation pressure differential coupler and venturi as in claim 2 wherein said securing means comprises:

a collar having a bore and threadably received on said sleeve, and a circumferentially continuous cam surface for engaging and deforming an outer free end of said sleeve radially inwardly into sealing engagement with the enlarged end of said inlet tube.

4. The exhaust recirculation pressure differential coupler and venturi as in claim 3 wherein said sleeve has an inside diameter larger than an outer diameter of the first end of said inlet tube.

5. The exhaust recirculation pressure differential coupler and venturi as in claim 3 wherein said collar has an inside diameter smaller than an outer diameter of said sleeve.

6. The exhaust recirculation pressure differential coupler and venturi as in claim 1 further comprising a baffle plate positioned within said coupler body and having an orifice for creating a pressure differential within the coupler body; and means on said coupler body to accommodate pressure sensors on each side of said baffle plate.

7. The exhaust recirculation pressure differential coupler and venturi as in claim 6 wherein exhaust gases flow from said inlet tube upstream of said baffle plate through the orifice and downstream through said outlet tube, and the orifice has a chamfer on the upstream side of said baffle plate to control exhaust gas flow therethrough.

8. An exhaust recirculation pressure differential coupler and venturi comprising:

a coupler body adapted to be connected between an exhaust manifold and an inlet manifold of an automotive engine for receiving exhaust gases flowing from the exhaust manifold;

said coupler body having a through passage and comprising a baffle plate with a chambered orifice within the passage through which the exhaust gases flow and a threaded sleeve having a counterbore at one end of said coupler body;

an angular inlet tube having an enlarged first end telescopically received within the counterbore of said sleeve and a second end adapted to be secured to the exhaust manifold;

a collar having a bore threadably received on said sleeve, said collar having an inside diameter smaller than the outside diameter of said sleeve;

a circumferentially continuous cam surface within said collar for engaging and deforming an outer free end of said sleeve radially inwardly into sealing engagement with said inlet tube; and an outlet tube having a first end connected to the other end of said coupler body and a second end connected to the inlet manifold.

9. The exhaust recirculation pressure differential coupler and venturi as in claim 8 further comprising means on said coupler body to accommodate sensors on each side of said baffle plate.

10. A method of assembling a self-aligning exhaust recirculation pressure differential coupler and venturi to an automotive engine assembly, the method comprising the steps of:

providing a coupler body having a through passage and a venturi therein through which exhaust gases flow, an outlet tube connected at a first end to one end of said coupler body; an adjustable inlet tube connected at a first end to the other end of said coupler body, and securing means to lock the inlet tube to an exhaust manifold;

connecting a second end of the inlet tube to an exhaust manifold;

adjusting the inlet tube relative to the coupler body to align a second end of the outlet tube to an intake manifold;

connecting the second end of the outlet tube to the intake manifold; and locking the inlet tube to the coupler body.

11. The exhaust recirculation pressure differential coupler and venturi as in claim 10 wherein the adjusting step is achieved by providing a telescopic connection between the inlet tube and the coupler body wherein the first end of the inlet tube is received in a threaded sleeve on the coupler body and the sleeve has an inside diameter larger than an outside diameter of the inlet tube.

12. The exhaust recirculation pressure differential coupler and venturi as in claim 10 wherein the locking step comprises the step of providing a circumferentially continuous cam surface on the securing means, and tightening the securing means on the threaded sleeve so that the cam surface deforms a free end of the threaded sleeve into engagement with the inlet tube.

* * * * *